US010634152B2

(12) United States Patent
Behnke et al.

(10) Patent No.: US 10,634,152 B2
(45) Date of Patent: Apr. 28, 2020

(54) MULTI-BEARING DESIGN FOR SHAFT STABILIZATION

(71) Applicant: ITT MANUFACTURING ENTERPRISES LLC., Wilmington, DE (US)

(72) Inventors: Paul Walter Behnke, Seal Beach, CA (US); Abhi Nutankumar Gandhi, South Pasadena, CA (US); Daniel Stephen Miller, Ontario (CA)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 64 days.

(21) Appl. No.: 15/999,163

(22) Filed: Aug. 17, 2018

(65) Prior Publication Data

US 2020/0056620 A1 Feb. 20, 2020

(51) Int. Cl.

| | |
|---|---|
| ***F04D 29/04*** | (2006.01) |
| ***F04D 29/041*** | (2006.01) |
| ***F04D 13/06*** | (2006.01) |

(52) U.S. Cl.

CPC ..... *F04D 29/0413* (2013.01); *F04D 13/06* (2013.01)

(58) Field of Classification Search

None

See application file for complete search history.

(56) References Cited

U.S. PATENT DOCUMENTS

| | | | |
|---|---|---|---|
| 2,220,524 | A | 11/1938 | Kapitza |
| 2,515,861 | A | 7/1950 | Campbell |
| 2,557,542 | A | 6/1951 | Kapitza |
| 2,571,802 | A | 10/1951 | Wilfley et al. |
| 2,729,518 | A | 1/1956 | O'Connor |
| 2,961,277 | A | 11/1960 | Sternlight |

(Continued)

FOREIGN PATENT DOCUMENTS

| | | | |
|---|---|---|---|
| EP | 1781951 | A | 5/2007 |
| GB | 966240 | | 8/1964 |

(Continued)

OTHER PUBLICATIONS

Kikuchi, Katsuaki, "Analysis of Unbalance Vibration of Rotating Shaft System with Many Bearings and Disks," Bulletin of USME 13.61, 1970, pp. 864-872. https://www.jstage.jst.go.jp/article/sme1958/13/61/13_61_864/_pdf.

(Continued)

*Primary Examiner* — Michael Lebentritt

(74) *Attorney, Agent, or Firm* — Moritt Hock & Hamroff LLP; Bret P. Shapiro

(57) ABSTRACT

A centrifugal pump features a bearing housing; a rotor shaft configured in the bearing housing; an impeller configured on the rotor shaft; a sealing arrangement having a seal configured between the rotor shaft and the bearing housing; and a multiple sleeve bearing arrangement positioned on a rotor span between the impeller and the sealing arrangement to provide rotor stabilization, the multiple bearing arrangement having a primary sleeve bearing configured between the rotor shaft and the bearing housing near or in close proximity to the impeller on the rotor span, and a secondary sleeve bearing configured between the rotor shaft and the bearing housing near or in close proximity to the sealing arrangement on the rotor span.

11 Claims, 2 Drawing Sheets

(56) References Cited

U.S. PATENT DOCUMENTS

| | | | | | |
|---|---|---|---|---|---|
| 3,395,949 | A | | 8/1968 | Kun | |
| 4,128,281 | A | | 12/1978 | Batkiewicz | |
| 4,272,084 | A | * | 6/1981 | Martinson | F16J 15/006 277/365 |
| 4,363,608 | A | | 12/1982 | Mulders | |
| 4,605,361 | A | * | 8/1986 | Cordray | F01C 1/067 418/38 |
| 4,664,595 | A | | 5/1987 | Tsuji et al. | |
| 5,076,755 | A | | 12/1991 | Okada | |
| 5,133,639 | A | | 7/1992 | Gay et al. | |
| 5,248,245 | A | * | 9/1993 | Behnke | F04D 29/061 415/110 |
| 5,491,598 | A | | 2/1996 | Stricklin et al. | |
| 5,496,150 | A | | 3/1996 | Claxton, III et al. | |
| 5,680,811 | A | * | 10/1997 | Highnote | A47J 37/1233 210/167.28 |
| 5,738,445 | A | | 4/1998 | Gardner | |
| 5,795,075 | A | * | 8/1998 | Watson | E21B 4/003 384/215 |
| 5,810,208 | A | | 9/1998 | Nixon, II et al. | |
| 5,827,168 | A | | 10/1998 | Howell | |
| 5,929,336 | A | * | 7/1999 | Belanger | F16N 29/04 73/593 |
| 5,944,482 | A | | 8/1999 | Cronin | |
| 6,091,175 | A | * | 7/2000 | Kinsinger | F16C 27/063 277/438 |
| 6,140,725 | A | * | 10/2000 | Jensen | F04D 13/062 310/61 |
| 6,566,774 | B2 | | 5/2003 | Parmeter et al. | |
| 7,052,253 | B2 | | 5/2006 | Izraelev | |
| 9,616,157 | B2 | | 4/2017 | Akdis | |
| 2012/0067595 | A1 | * | 3/2012 | Noske | E21B 23/02 166/373 |
| 2012/0139250 | A1 | * | 6/2012 | Inman | E21B 21/10 290/52 |
| 2012/0251362 | A1 | * | 10/2012 | Forsberg | F04D 1/06 417/423.12 |
| 2014/0127052 | A1 | * | 5/2014 | Knapp | F04D 13/10 417/410.1 |
| 2015/0143822 | A1 | * | 5/2015 | Chalmers | F04D 13/086 62/50.6 |
| 2015/0345265 | A1 | * | 12/2015 | Cunningham | F04D 13/083 415/1 |
| 2016/0169232 | A1 | * | 6/2016 | Li | F04D 13/0626 417/423.7 |
| 2019/0085672 | A1 | * | 3/2019 | McMullen | E21B 4/003 |
| 2019/0264735 | A1 | * | 8/2019 | Crane | F04D 25/0686 |

FOREIGN PATENT DOCUMENTS

| | | | |
|---|---|---|---|
| GB | 1583902 | | 2/1981 |
| RU | 2162163 | C1 | 1/2001 |
| WO | 2015098711 | A1 | 7/2015 |
| WO | 2016146663 | A1 | 9/2016 |

OTHER PUBLICATIONS

English language Abstract of WO2015098711.

English language Abstract of RU2162163.

Kikuchi, Katsuaki, "Analysis of unbalance vibration of rotating shaft system with many bearings and disks," Bulletin of JSME 13.61,1970, pp. 864-872. https://www.jstage.jst.go.pj/article/jsme1958/13/61/13_61_864/_pdf.

Keogh, Patrick S., et al., "On the control of synchronous vibration in rotor/magnetic bearing systems involving auxiliary bearing contact." Transactions of the ASME-A-Engineering for Gas Turbines and Power 126.2, 2004, pp. 366-372. http://citeseerx.ist.psu.edu/viewdoc/download?doi=10.1.1.467.1032&rep=rep1&type=pdf.

Lawen, James L., and George T. Flowers, Synchronous Dynamics of a Coupled Shaft-bearing-housing System with Auxiliary Support for a Clearance Bearing: Analysis and Experiment, National Aeronautics and Space Administration, 1992. https://ntrs.nasa.gov/archive/nasa/casi.ntrs.nasa.gov/19950026272.pdf.

Reitsma, Todd W., "Development of Long-Life Auxiliary Bearings for Critical Service Turbo-Machinery and High-Speed Motors," 8th International Symposium on Magnetic Bearings (ISMB8), Mito, Japan, Aug. 2002. http://www.mech.ibaraki.ac.jp/~ismb8/pocpdf/0120.pdf.

* cited by examiner

MULTI-BEARING DESIGN FOR SHAFT STABILIZATION

BACKGROUND OF THE INVENTION

1. Field of the Invention

The present invention relates to a pump; more particularly to a bearing design for a pump.

2. Brief Description of Related Art

In centrifugal process pumps, there is very often high pressure at the inlet of pump. This suction pressure results in a compressive axial thrust force on the pump rotor. This compressive thrust opposes the hydraulic axial thrust. When the suction pressure is sufficiently high, the compressive thrust overcomes the hydraulic thrust keeping the rotor in tension. This resulting compression can causes the rotor to bend away from the central rotational axis, and 'whirl' about as it spins. The rotor can then become unstable, vibrate, and potentially cause damage to machinery.

This operation of the rotor in compression is avoided in pumps whenever possible. Because of this, there are some high suction pressure conditions when a suitable pump is not available for that application.

There is a need in the industry for a better way to stabilize a rotor of a pump, especially centrifugal pumps like that described above.

SUMMARY OF THE INVENTION

In summary, the present invention places multiple bearings in locations that result in additional rotor stabilization. By positioning bearings on the rotor span between the impellers and the seal, the whirl induced on the rotor can be contained and limited.

Realization of the present invention can include piping running from the intermediate chambers between the bearings. The effect of increased fluid flow through sleeve bearings acts to stabilize the rotor. By using multiple bearings, flow through individual bearings can be controlled and increased through intermediate piping in order to provide additional rotor stabilization.

The present invention can be realized with or without utilizing intermediate piping connections, and can also consist of any number of bearings (2 or greater).

The present invention can be used to control seal chamber pressure and/or flow.

By way of example, a pump was run with high suction pressure in a 2 bearing arrangement. This acted to stabilize the rotor under compressive axial thrust. Rotor vibrations were kept low enough that the pump was able to operate continuously under compressive axial thrust load.

In effect, the substantial difference between the present invention and the prior art set forth above is that:

(1) The present invention may be effectively used in pump applications when the rotor is subject to a constant compressive load. As such, the stabilization provided by the multiple sleeve bearing arrangement is unique to these types of pump applications.

(2) In the present invention, the rotor stabilization is achieved utilizing hydrostatic sleeve bearings, e.g., instead of either rolling element bearings, or hydrodynamic bearings.

SPECIFIC EMBODIMENTS

By way of example, and according to some embodiments, the present invention may include, or take the form of, a new and unique pump featuring a bearing housing;

a rotor shaft configured in the bearing housing;

an impeller configured on the rotor shaft;

a sealing arrangement having a seal configured between the rotor shaft and the bearing housing; and a multiple sleeve bearing arrangement positioned on a rotor span between the impeller and the sealing arrangement to provide rotor stabilization, the multiple bearing arrangement having

- a primary sleeve bearing configured between the rotor shaft and the bearing housing near or in close proximity to the impeller on the rotor span, and
- a secondary sleeve bearing configured between the rotor shaft and the bearing housing near or in close proximity to the sealing arrangement on the rotor span.

Other Specific Features

The present invention may also include one or more of the following features:

The pump may be a centrifugal pump.

The primary sleeve bearing and/or the secondary sleeve bearing may include, or take the form of, hydrostatic sleeve bearings.

The multiple sleeve bearing arrangement may include a second secondary sleeve bearing configured between the primary sleeve bearing and the secondary sleeve bearing. (The second secondary sleeve bearing is also referred to herein as a third sleeve bearing.)

Embodiments are envisioned, and the scope of the invention is intended to include, implementing some combination of the primary sleeve bearing and the secondary sleeve bearing as hydrodynamic sleeve bearings.

The bearing housing may include, or takes the form of, a two-part bearing housing having an upper bearing housing and a lower bearing housing that are configured to form a so-called "between" bearing fluid chamber for containing bearing fluid/liquid in the bearing housing between the primary sleeve bearing and the secondary sleeve bearing.

By way of further example, and according to some embodiments, the present invention may include, or take the form of, a centrifugal pump featuring a bearing housing; a rotor shaft configured in the bearing housing; an impeller configured on the rotor shaft; a sealing arrangement having a seal configured between the rotor shaft and the bearing housing; and a multiple fluid sleeve bearing arrangement positioned on a rotor span between the impeller and the sealing arrangement to provide rotor stabilization, the multiple bearing arrangement having a primary hydrostatic sleeve bearing configured between the rotor shaft and the bearing housing near or in close proximity to the impeller on the rotor span, and a secondary hydrostatic sleeve bearing configured between the rotor shaft and the bearing housing near or in close proximity to the sealing arrangement on the rotor span.

The present invention provides a better way to stabilize a rotor of a pump, e.g., including a centrifugal pump.

BRIEF DESCRIPTION OF THE DRAWING

The drawing includes FIGS. 1-2, which are not necessarily drawn to scale:

In FIGS. 1-2, similar elements are shown having similar reference numerals.

DETAILED DESCRIPTION OF THE INVENTION

FIG. 1

Figure 1:
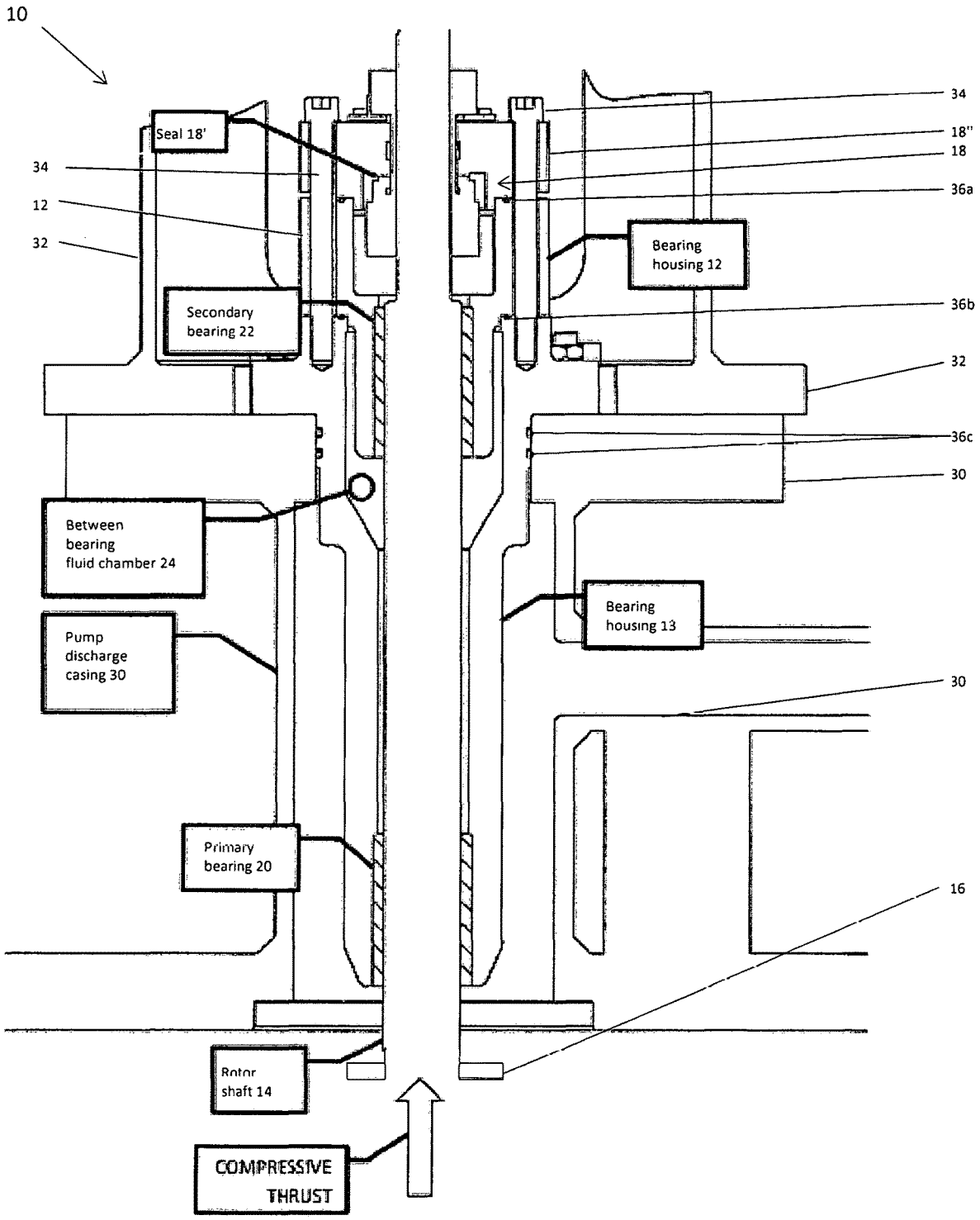
FIG. 1 is a diagram of a pump having a multiple sleeve bearing arrangement positioned on a rotor span between an impeller and a sealing arrangement to provide rotor stabilization, according to some embodiments of the present invention.

By way of example, FIG. 1 shows a new and unique pump generally indicated as 10, according to some embodiments of the present invention. The pump may include, or take the form of, a centrifugal pump.

In FIG. 1, the centrifugal pump 10 includes a bearing housing 12, 13; a rotor shaft 14 configured in the bearing housing 12; an impeller 16 configured on the rotor shaft 14; a sealing arrangement 18 having a seal 18' configured between the rotor shaft 14 and the bearing housing 12; and a multiple sleeve bearing arrangement 20, 22 positioned on a rotor span between the impeller 16 and the sealing arrangement having the seal 18' to provide rotor stabilization.

The multiple bearing arrangement may include a primary sleeve bearing 20 configured between the rotor shaft 14 and the bearing housing 13 near or in close proximity to the impeller 16 on the rotor span, and a secondary sleeve bearing 22 configured between the rotor shaft 14 and the bearing housing 12 near or in close proximity to the sealing arrangement 18 having the seal 18' on the rotor span. (By way of example, in the present invention the multiple sleeve bearings are used to support the rotor and may be located in a range of approximately 1 to 3 feet measured from the seal.) The bearing housing 12, 13 may include, or may take the form of, a two-part bearing housing having an upper bearing housing 12 and a lower bearing housing 13 that are configured to form a so-called "between" bearing fluid chamber 24 for containing bearing fluid/liquid, e.g., such as oil or water, in the bearing housing 12, 13 between the primary sleeve bearing 20 and the secondary sleeve bearing 22. As one skilled in the art would appreciate, the rotor span is understood to be a span or distance along the rotor shaft 14 extending from near or in close proximity to the top of the impeller 16 and near or in close proximity to the bottom of the sealing arrangement 18 having the seal 18', e.g., consistent with that shown and described herein.

By way of example, and according to some embodiments, either or both of the primary sleeve bearing 20 and the secondary sleeve bearing 22 may include, or take the form of, a hydrostatic sleeve bearing, which are described in further detail below.

Other Pump Components

In FIG. 1, the pump 10 is understood to include other components or parts that do not form part of the underlying invention per se, e.g., including a pump discharge casing 30; a driver support 32; bolts 34 for coupling together the upper bearing housing 12 and a cap 18" forming part of the sealing arrangement 18 having the seal 18'; and also including various O-rings indicated by reference numeral 36*a*, 36*b*, 36*c*, e.g., for providing O-ring seals 36*a* between the upper bearing housing 12 and the cap 18", or for providing O-ring seals 36*b* between the upper bearing housing 12 and the lower bearing housing 13; or for providing O-ring seals 36*c* between the lower bearing housing and the pump discharge casing 30. The pump 10 also includes other components or parts that are shown but not labeled in FIG. 1, of which the structure and functionality would be understood and appreciate by one skilled in the art.

FIG. 1 also shows an arrow generally indicating a compressive thrust imposed on the rotor shaft 14 by the liquid/fluid.

Sleeve Bearings

In general, and as one skilled in the art would appreciate, a sleeve bearing is understood to be a machine bearing in which an axle or shaft turns in a sleeve that is often grooved to facilitate distribution of lubricant to the sleeve bearing. A sleeve bearing is a kind of cylindrical bearing, e.g., having a single internal rotating cylinder inside it. Sleeve bearings are porous, so they draw up the oil applied on the outer sleeve. Sleeve bearings are also understood to be a kind of plain bearing, e.g., having few moving parts. In contrast, many spherical ball bearings have an internal ring, which is lined with smaller balls inside. In contrast to regular ball bearings, a sleeve bearing only has two moving parts; the outer sleeve and the inner rotating cylinder. They are also known as journal bearings, after the technical term for the outer sleeve. By way of example, the outer journey of a sleeve bearing may be whole, split, or clenched between the two halves.

By way of example, sleeve bearings may be made of compressed powdered metal, such as bronze or copper. Because of the material from which they are made, the metal is microscopically porous. When they are oiled on the outside, the oil will be drawn up through the pores to lubricate the inner cylinder.

By way of further example, a sleeve bearing may be lubricated in a number of ways besides oiling. Sometimes, molten metal or graphite is used. Some man-made polymers can lubricate moving parts without seizing up in extremely cold temperatures. Other sleeve bearings are surfaced with porous, oiled hardwood so that the oil will be drawn up into them more readily.

The scope of the invention is not intended to be limited to any particular type or kind of sleeve bearing, e.g., including those both now known and later developed in the future.

By way of still a further example, see U.S. Pat. No. 2,499,456 that discloses a bearing sleeve for a pump shaft, and U.S. Pat. No. 4,354,808 that discloses a vane pump having a sleeve bearing and rotor retaining constructions, which are both incorporated by reference in their entirety.

Fluid Bearings

As one skilled in the art would also appreciate and understand, fluid bearings are bearings in which the load is supported by a thin layer of rapidly moving pressurized liquid or gas between the bearing surfaces. Since there is no contact between the moving parts, there is no sliding friction, allowing fluid bearings to have lower friction, wear and vibration than many other types of bearings.

They can be broadly classified into two types: fluid dynamic bearings (also known as hydrodynamic bearings)

and hydrostatic bearings. Hydrostatic bearings are externally pressurized fluid bearings, where the fluid is usually oil, water or air, and the pressurization is done by a pump. Hydrodynamic bearings rely on the high speed of the journal (the part of the shaft resting on the fluid) to pressurize the fluid in a wedge between the faces. Fluid bearings are frequently used in high load, high speed or high precision applications where ordinary ball bearings would have short life or cause high noise and vibration. They are also used increasingly to reduce cost.

Fluid bearings are noncontact bearings that use a thin layer of rapidly moving pressurized liquid or gas fluid between the moving bearing faces, typically sealed around or under the rotating shaft. The moving parts do not come into contact, so there is no sliding; the load force is supported solely by the pressure of the moving fluid.

There are two principal ways of getting the fluid into the bearing:

In fluid static, hydrostatic and many gas or air bearings, the fluid is pumped in through an orifice or through a porous material. Such bearings should be equipped with the shaft position control system, which adjusts the fluid pressure and consumption according to the rotation speed and shaft load. Hydrostatic bearings rely on an external pump. The power required by that pump contributes to system energy loss, just as bearing friction otherwise would. Better seals can reduce leak rates and pumping power, but may increase friction. By way of example, the following United States Patents disclose hydrostatic bearings: U.S. Pat. Nos. 5,281,032; 2,998,999; 3,476,447; and 3,359,613; which are all incorporated by reference in their entirety.

In fluid-dynamic bearings, the bearing rotation sucks the fluid on to the inner surface of the bearing, forming a lubricating wedge under or around the shaft. Hydrodynamic bearings rely on bearing motion to suck fluid into the bearing, and may have high friction and short life at speeds lower than design, or during starts and stops. An external pump or secondary bearing may be used for startup and shutdown to prevent damage to the hydrodynamic bearing. A secondary bearing may have high friction and short operating life, but good overall service life if bearing starts and stops are infrequent. By way of example, the following United States Patents disclose hydrodynamic bearings: U.S. Pat. Nos. 5,733,048; 6,264,003 and 9,518,426; which are all incorporated by reference in their entirety.

Figure 2:
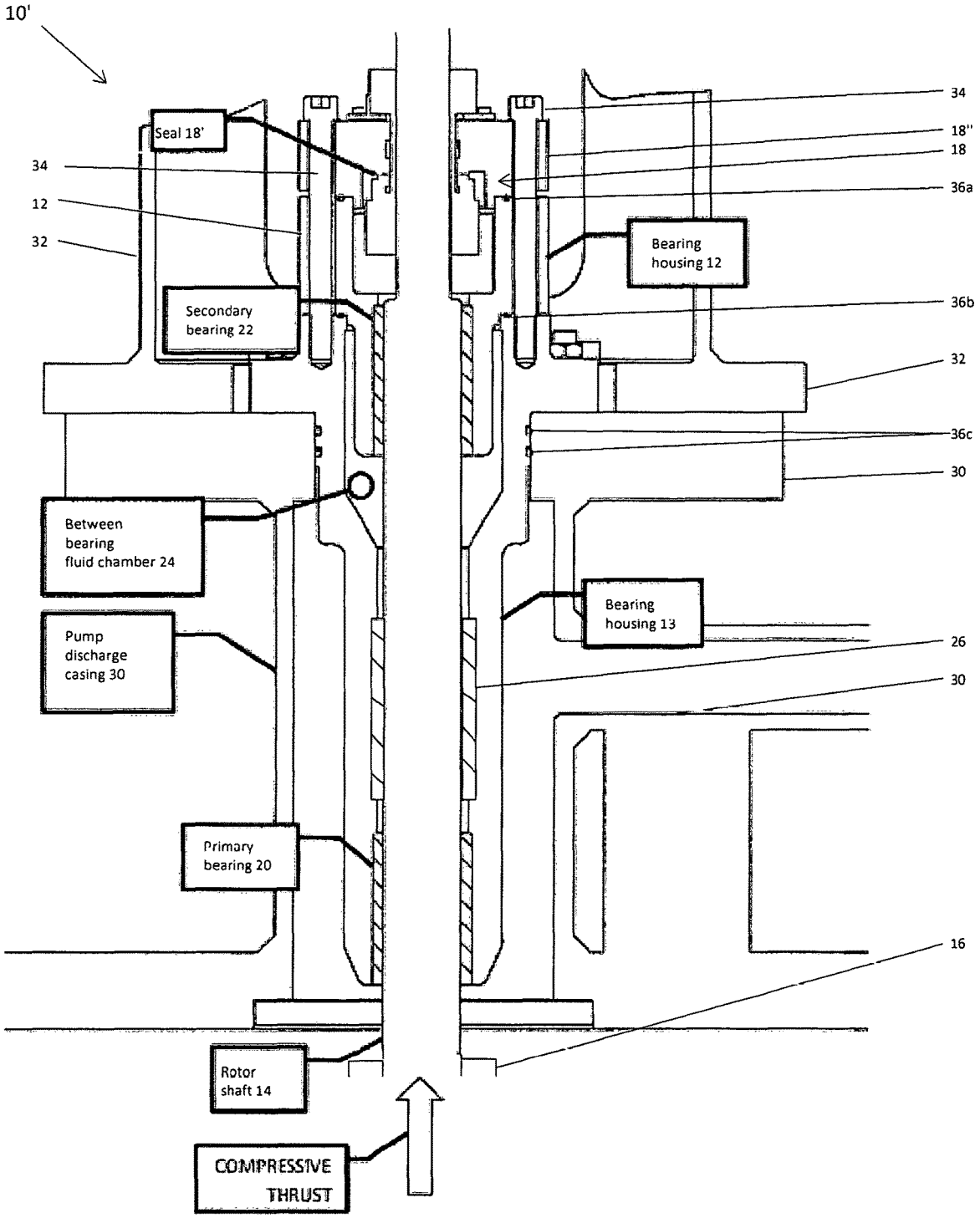
FIG. 2 is a diagram of a pump having a multiple sleeve bearing arrangement positioned on a rotor span between an impeller and a sealing arrangement to provide rotor stabilization, e.g., having three or more sleeve bearings (including a third sleeve bearing shown), according to some embodiments of the present invention.

FIG. 2: A Third Bearing Sleeve 26

By way of further example, FIG. 2 shows a pump generally indicated as 10' having a multiple bearing arrangement with a third and intermediate sleeve bearing 26 configured between the primary sleeve bearing 20 and the secondary sleeve bearing 22. By way of example, and according to some embodiments, the third and intermediate sleeve bearing 26 may include, or take the form of, a hydrostatic sleeve bearing, consistent with that set forth herein.

Embodiments are envisioned, and the scope of the invention is intended to include, implementing other types or kinds of multiple bearing arrangements having more than three sleeve bearings, e.g., including four (4) sleeve bearing arrangements, five (5) sleeve bearing arrangements, etc.

The scope of the invention is not intended to be limited to the number of sleeve bearings in the multiple bearing arrangement, the axial or radial dimension of the sleeve bearings, etc. By way of example, embodiments are envisioned for implementing multiple bearing arrangement along a rotor shaft having a predetermined length, where a first multiple bearing arrangement may include two sleeve bearings having a first set of axial and radial dimensions to fit within the predetermined length along the rotor shaft, as well as where a second multiple bearing arrangement may include three or more sleeve bearings having a second set of axial and radial dimensions that are either larger or smaller than the first set to fit within the predetermined length along the rotor shaft.

Other Examples of U.S. Patents Disclosing Pumps Having Rotors with Bearings

By way of example, U.S. Pat. No. 2,571,802 discloses a centrifugal pump having front and rear bearing portions with ball bearings, balls, and inner and outer bearing races; and U.S. Pat. No. 2,729,518 discloses a shaft arrangement having a shaft, a vibration stabilizer located intermediate bearing supports and forming a third bearing support, and rotating masses on the shaft between the vibration stabilizer the bearing supports, which are both hereby incorporated by reference in their entirety.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the invention has been described and illustrated with respect to exemplary embodiments thereof, the foregoing and various other additions and omissions may be made therein and thereto without departing from the spirit and scope of the present invention.

What is claimed is:

1. A pump comprising:

a bearing housing;

a rotor shaft configured in the bearing housing;

an impeller configured on the rotor shaft;

a sealing arrangement having a seal configured between the rotor shaft and the bearing housing; and a multiple sleeve bearing arrangement positioned on a rotor span between the impeller and the sealing arrangement to provide rotor stabilization, the multiple bearing arrangement having a primary sleeve bearing configured between the rotor shaft and the bearing housing near or in close proximity to the impeller on the rotor span, and a secondary sleeve bearing configured between the rotor shaft and the bearing housing near or in close proximity to the sealing arrangement on the rotor span.

2. A pump according to claim 1, wherein the pump is a centrifugal pump.

3. A pump according to claim 1, wherein the multiple sleeve bearing arrangement comprises a third sleeve bearing configured between the primary sleeve bearing and the secondary sleeve bearing.

4. A pump according to claim 1, wherein the primary sleeve bearing is a hydrostatic sleeve bearing.

5. A pump according to claim 1, wherein the secondary sleeve bearing is a hydrostatic sleeve bearing.

6. A pump according to claim 1, wherein the primary sleeve bearing and the secondary sleeve bearing are hydrostatic sleeve bearings.

7. A pump according to claim 1, wherein some combination of the primary sleeve bearing and the secondary sleeve bearing are hydrodynamic sleeve bearings.

8. A pump according to claim 1, wherein the bearing housing includes, or takes the form of, a two-part bearing housing having an upper bearing housing and a lower bearing housing that are configured to form a "between" bearing fluid chamber for containing bearing fluid/liquid in the bearing housing between the primary sleeve bearing and the secondary sleeve bearing.

9. A centrifugal pump comprising:

a bearing housing;

a rotor shaft configured in the bearing housing;

an impeller configured on the rotor shaft;

a sealing arrangement having a seal configured between the rotor shaft and the bearing housing; and a multiple fluid sleeve bearing arrangement positioned on a rotor span between the impeller and the sealing arrangement to provide rotor stabilization, the multiple bearing arrangement having a primary hydrostatic sleeve bearing configured between the rotor shaft and the bearing housing near or in close proximity to the impeller on the rotor span, and a secondary hydrostatic sleeve bearing configured between the rotor shaft and the bearing housing near or in close proximity to the sealing arrangement on the rotor span.

10. A centrifugal pump according to claim 9, wherein the multiple fluid sleeve bearing arrangement comprises a third hydrostatic sleeve bearing configured between the primary hydrostatic sleeve bearing and the secondary hydrostatic sleeve bearing.

11. A pump according to claim 9, wherein the bearing housing includes, or takes the form of, a two-part bearing housing having an upper bearing housing and a lower bearing housing that are configured to form a "between" bearing fluid chamber for containing bearing fluid/liquid in the bearing housing between the primary sleeve bearing and the secondary sleeve bearing.

* * * * *